US005713776A

United States Patent [19]

Hou

[11] Patent Number: 5,713,776

[45] Date of Patent: Feb. 3, 1998

[54] ROTARY MECHANISM OF A TOY

[76] Inventor: Chin-Jung Hou, 58, Ma Yuan West St., Taichung, Taiwan

[21] Appl. No.: 615,720

[22] Filed: Mar. 13, 1996

[51] Int. Cl.[6] ..... A63H 33/26; G09F 19/00

[52] U.S. Cl. ..... 446/136; 40/426

[58] Field of Search ..... 446/136, 135, 446/134, 133, 129, 139, 236, 357; 40/426

[56] References Cited

U.S. PATENT DOCUMENTS

| | | | |
|---|---|---|---|
| 4,177,592 | 12/1979 | Ruck | 446/136 X |
| 4,838,825 | 6/1989 | Hwang et al. | 446/136 |
| 5,417,605 | 5/1995 | Chan | 446/136 |
| 5,435,086 | 7/1995 | Huang | 446/436 X |

FOREIGN PATENT DOCUMENTS

| | | | |
|---|---|---|---|
| 1129930 | 1/1957 | France | 446/136 |
| 1311470 | 10/1962 | France | 446/136 |
| 647284 | 12/1950 | United Kingdom | 446/436 |

*Primary Examiner*—D. Neal Muir

[57] ABSTRACT

A rotary mechanism is disposed in a hollow shell. The shape of the hollow shell is a toy spectacle or a terrestrial globe. Two rotary articles are disposed on the hollow shell. The rotary mechanism has a motor to drive a gear device. The gear device has a pinion engaged with a gear. A follower shaft connects the center of the gear and a follower plate. At least two rings are disposed on the follower plate. Each ring encircles a magnet. Each rotary article has a magnet thereunder.

3 Claims, 6 Drawing Sheets

ROTARY MECHANISM OF A TOY

BACKGROUND OF THE INVENTION

The invention relates to a rotary mechanism of a toy. More particularly, the invention relates to a rotary mechanism of a toy spectacle or a terrestrial globe.

Most conventional toy device cannot be rotated with two or more articles thereon. It is difficult to rotate an article on a toy. It is very difficult to rotate two or more articles on a toy.

SUMMARY OF THE INVENTION

An object of the invention is to provide a rotary mechanism of a toy in order to rotate two or more articles thereon.

Another object of the invention is to provide a toy spectacle in order to rotate two or more articles thereon.

Another object of the invention is to provide a terrestrial globe in order to rotate two or more articles thereon.

Accordingly, a rotary mechanism is disposed in a hollow shell. The shape of the hollow shell is a toy spectacle or a terrestrial globe. The hollow spectacle shell has at least a through hole to receive a mirror plate transversely. A plurality of houses and trees are disposed on the spectacle shell. The base plate is encircled by a bottom of the spectacle shell. A rotary mechanism is disposed on the base plate. The rotary mechanism comprises a cell chamber, a loudspeaker, an integrated circuit board, a switch and a transmission device. The transmission device comprises a motor, a gear box and a follower plate. The motor is disposed on the base plate. The motor has a driving shaft. A driving disk is disposed on a top end of the driving shaft. The gear box is disposed above the base plate. A plurality of posts are disposed on the base plate to support the gear box. A press plate extends transversely from the top of the gear box to cover the motor. A driven shaft and a follower shaft cross the gear box longitudinally. A driven disk is disposed on a top end of the driven shaft. A belt surrounds the driving disk and the driven disk. A follower plate is disposed on a top end of the follower shaft. A first, a second and a third rings are disposed on the center and two ends of the follower plate, respectively. Each of the first, second and third rings encircles a corresponding first, second and third magnet, respectively. The second and third magnets attract each other, but the first magnet has an unlike magnetism. A fourth or fifth magnet is disposed beneath each of the first or second doll, respectively. The fourth magnet attracts the second and third magnets. The fifth magnets attracts the second and third magnets. Each of the fourth and fifth magnets is enclosed by a plastic casing. A driven pinion is disposed on the middle portion of the driven shaft. A follower gear is disposed on the middle portion of the follower shaft. The driven pinion engages with the follower gear. The driving shaft of the motor drives the driven disk to rotate. The driven shaft and the driven pinion are rotated simultaneously. The driven pinion drives the follower gear to rotate. The follower shaft and the follower plate are rotated simultaneously.

Another embodiment illustrates a globe shell with a rotary mechanism. The hollow globe shell has a base plate and a rotary mechanism therein. A first and second airplanes are disposed on the globe shell. Each airplane has a magnet beneath the airplane. Each magnet is enclosed by a plastic casing. The rotary mechanism is similar to that of the first embodiment except that the follower plate is elongated. Two ends of the elongated follower plate abutting the globe shell. Two magnets are disposed at two ends of the elongated follower plate, respectively.

DETAILED DESCRIPTION OF THE INVENTION

Figure 1:
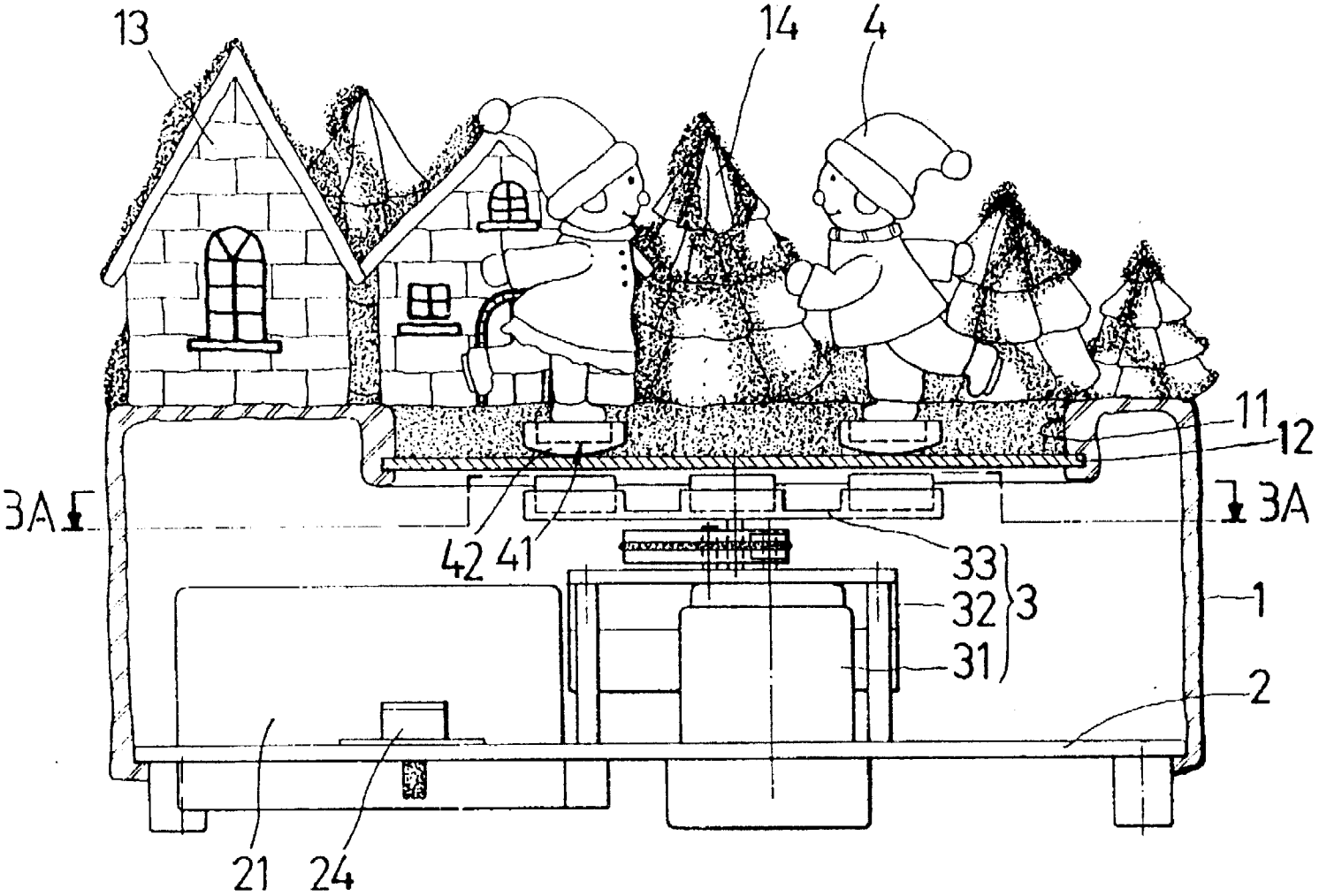
FIG. 1 is a front elevational view of a toy spectacle of a preferred embodiment in accordance with the invention.
Figure 2:
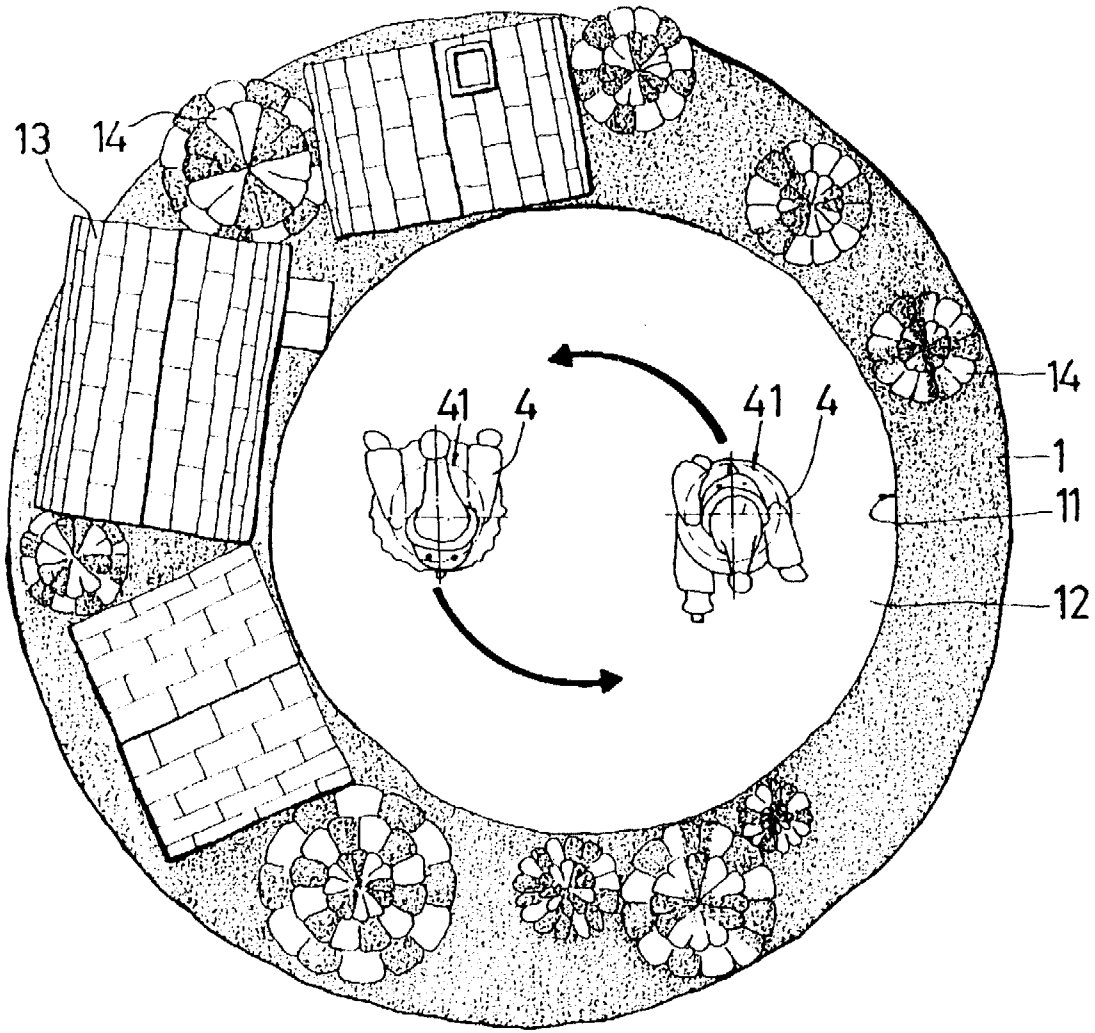
FIG. 2 is a top plan view of FIG. 1.
Figure 3:
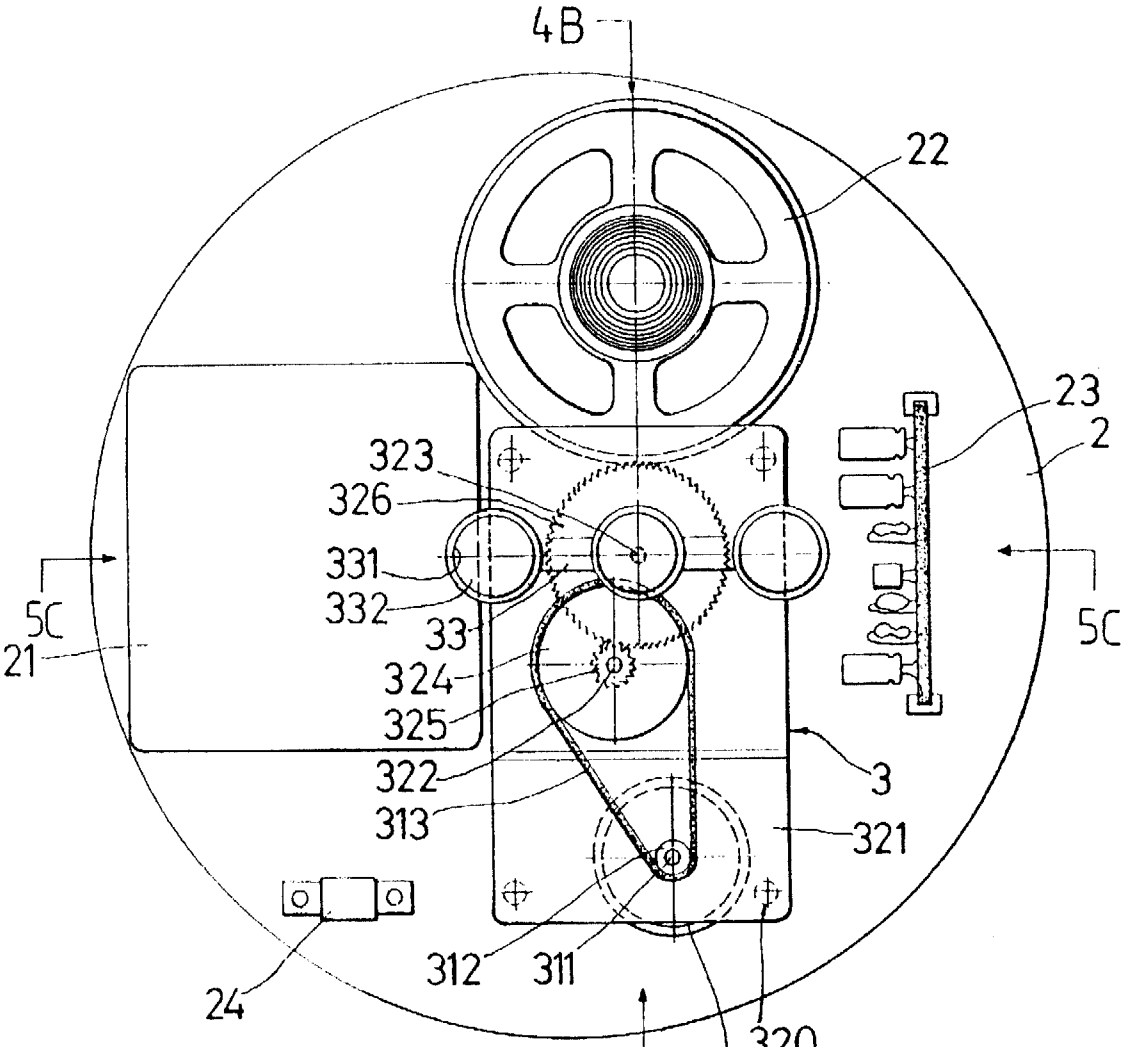
FIG. 3 is a top plan view of a rotary mechanism taken along line 3A—3A in FIG. 1.

Referring to FIGS. 1 to 3, a toy spectacle comprises a spectacle shell 1, a base plate 2 disposed under the spectacle shell 1, a rotary mechanism disposed in the spectacle shell 1, and a first and second dolls 4 disposed on the spectacle shell 1.

Referring to FIGS. 1 and 3, the hollow spectacle shell 1 has at least a through hole 11 to receive a mirror plate 12 transversely. A plurality of houses 13 and trees 14 are disposed on the spectacle shell 1. The base plate 2 is encircled by a bottom of the spectacle shell 1. A rotary mechanism is disposed on the base plate 2. The rotary mechanism comprises a cell chamber 21, a loudspeaker 22, an integrated circuit board 23, a switch 24 and a transmission device 3.

Figure 4:
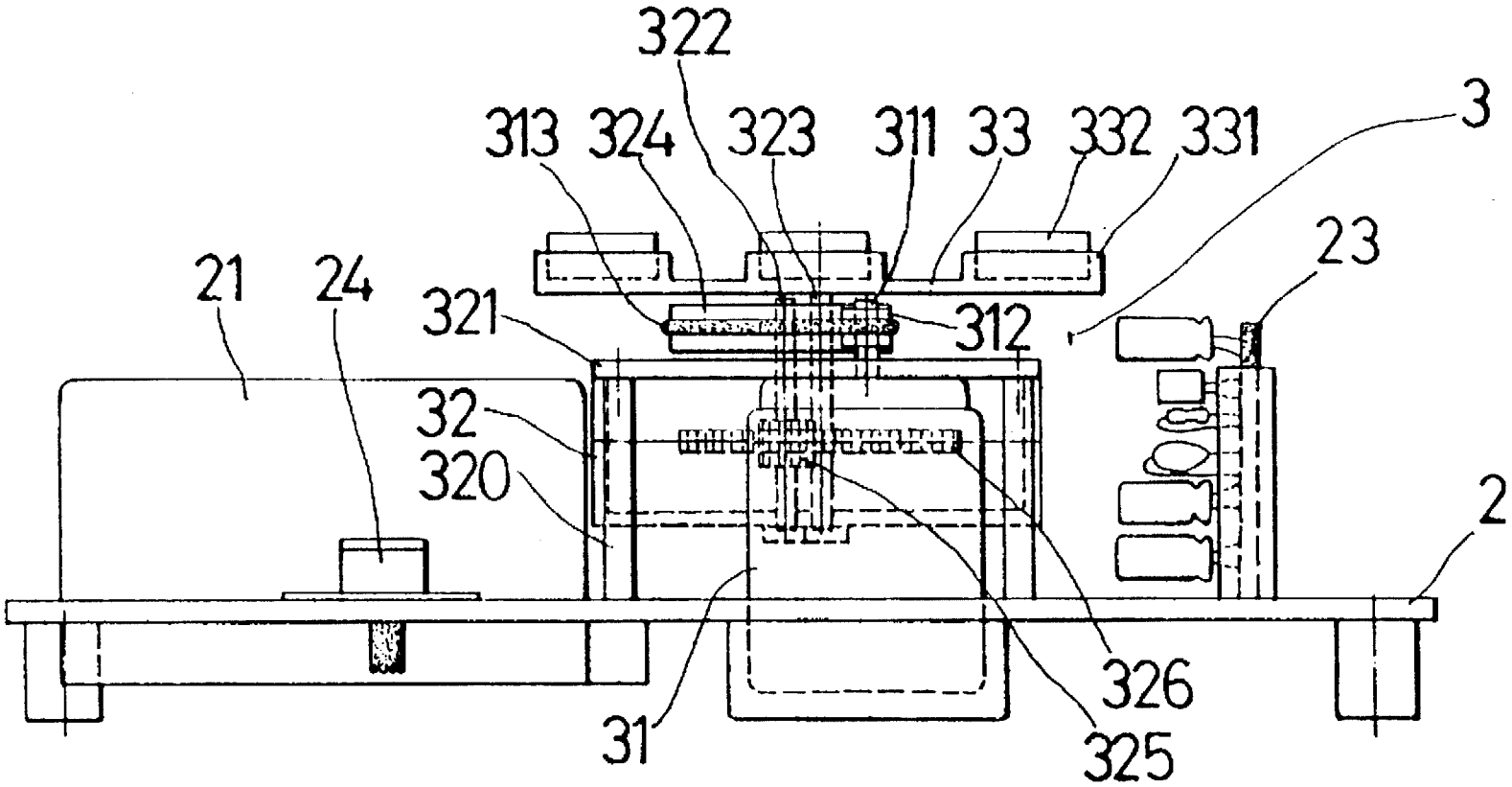
FIG. 4 is a side elevational view of FIG. 3 taken along line 4B—4B in FIG. 3.
Figure 5:
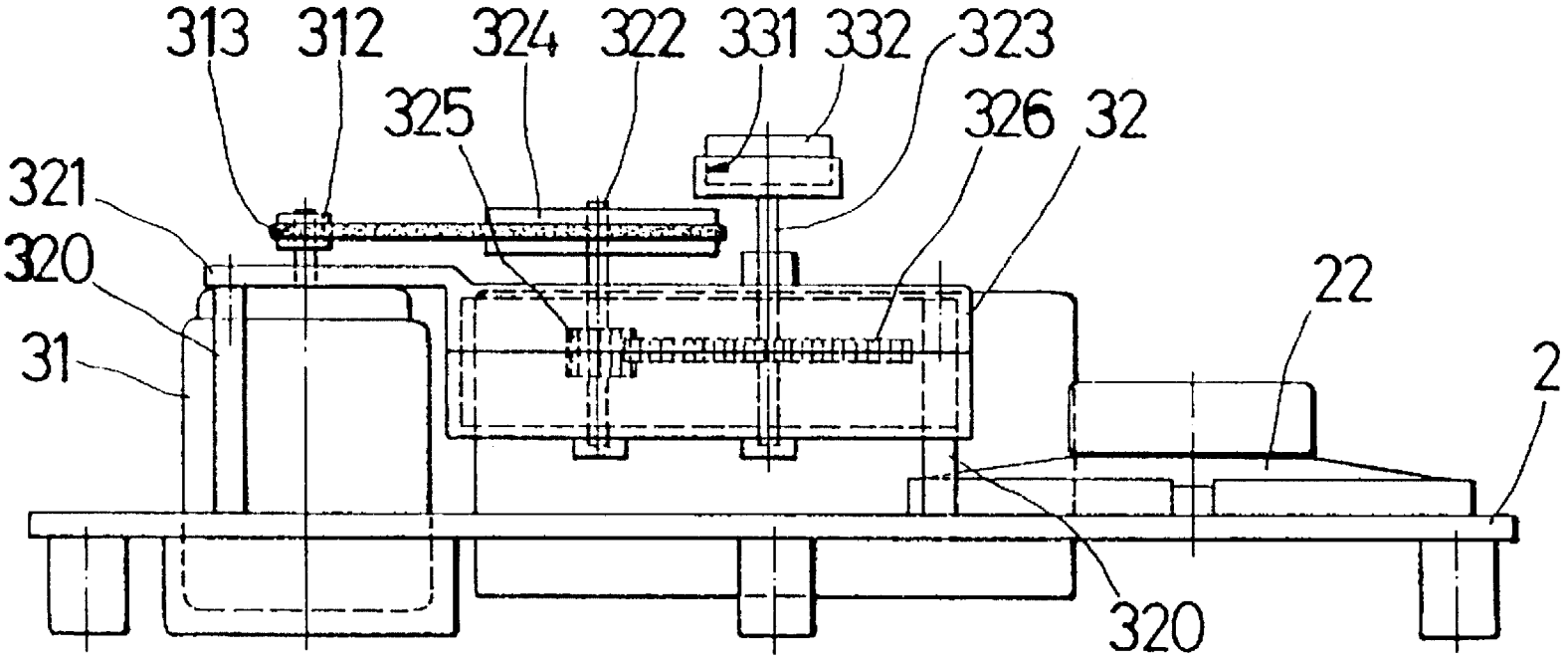
FIG. 5 is a side elevational view of FIG. 3 taken along line 5C—5C in FIG. 3.

Referring to FIGS. 3 to 5, the transmission device 3 comprises a motor 31, a gear box 32 and a follower plate 33. The motor 31 is disposed on the base plate 2. The motor 31 has a driving shaft 311. A driving disk 312 is disposed on a top end of the driving shaft 311. The gear box 32 is disposed above the base plate 2. A plurality of posts 320 are disposed on the base plate 2 to support the gear box 32. A press plate 321 extends transversely from the top of the gear box 32 to cover the motor 31. A driven shaft 322 and a follower shaft 323 cross the gear box 32 longitudinally. A driven disk 324 is disposed on a top end of the driven shaft 322. A belt 313 surrounds the driving disk 312 and the driven disk 324. A follower plate 33 is disposed on a top end of the follower shaft 323. A first, a second and a third rings 331 are disposed on the center and two ends of the follower plate 33, respectively. Each of the first, second and third rings 331 encircles a corresponding first, second and third magnet 332, respectively. The second and third magnets 332 attract each other. However, the first magnet 332 has an unlike magnetism. A fourth or fifth magnet 41 is disposed beneath each of the first or second doll 4, respectively. The fourth magnet 41 attracts the second and third magnets 332. The fifth magnets 41 attracts the second and third magnets 332. Each of the fourth and fifth magnets 41 is enclosed by a plastic casing 42. A driven pinion 325 is disposed on the middle portion of the driven shaft 322. A follower gear 326 is disposed on the middle portion of the follower shaft 323. The driven pinion 325 engages with the follower gear 326. The driving shaft 311 of the motor 31 drives the driven disk 324 to rotate. The driven shaft 322 and the driven pinion 325 are rotated simultaneously. The driven pinion 325 drives the follower gear 326 to rotate. The follower shaft 323 and the follower plate 33 are rotated simultaneously.

Figure 6:
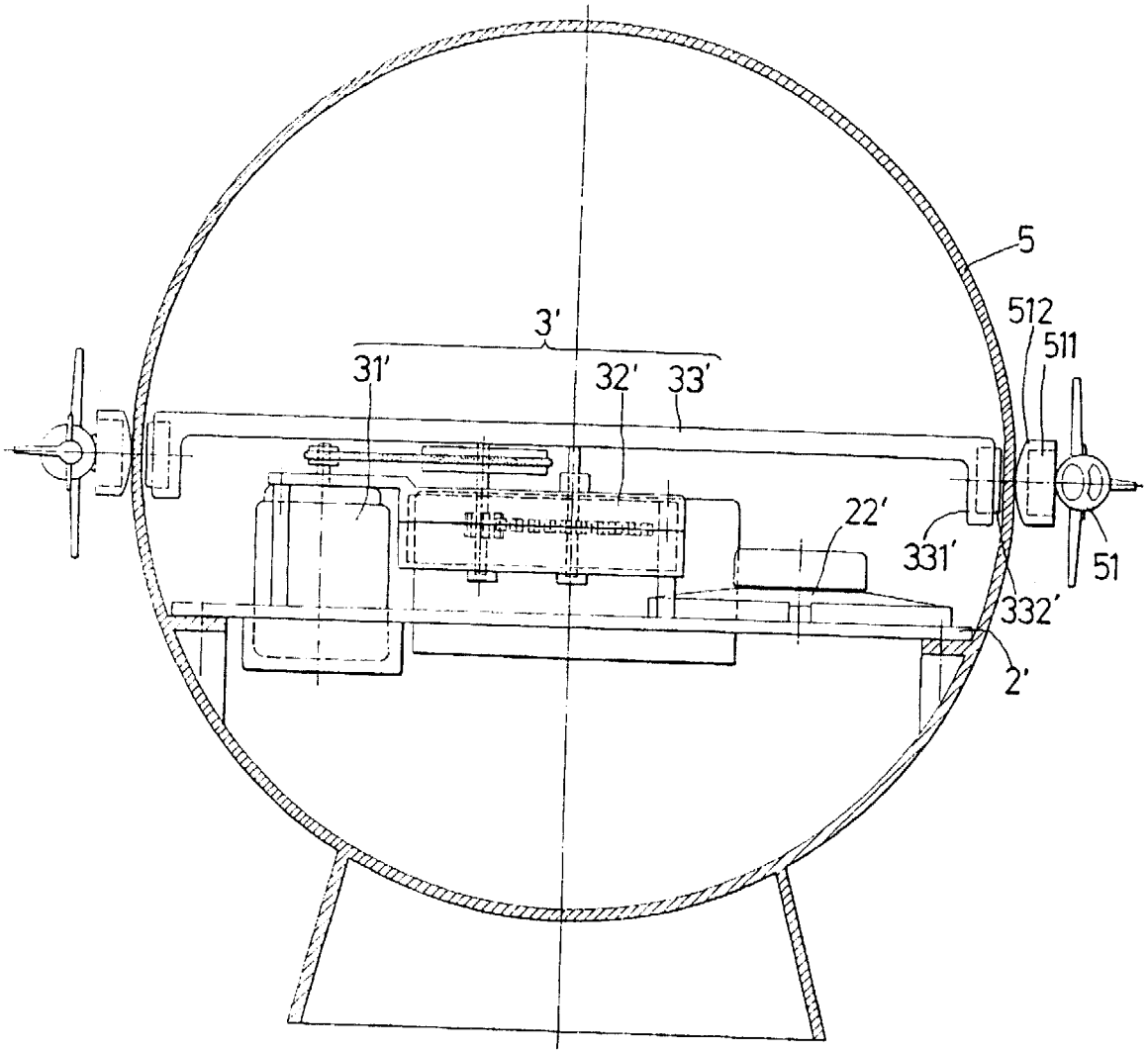
FIG. 6 is a schematic view of a terrestrial globe of another preferred embodiment in accordance with the invention.

Referring to FIG. 6, a hollow globe shell 5 has a base plate 2' and a rotary mechanism 3' therein. A first and second airplanes 51 are disposed on the globe shell 5. Each airplane 51 has a magnet 511 beneath the airplane 51. Each magnet 511 is enclosed by a plastic casing 512. The rotary mechanism 3' is similar to the rotary mechanism 3 except that the follower plate 33' is elongated. Two ends of the elongated follower plate 33' abutting the globe shell 5. Two magnets 331' are disposed at two ends of the elongated follower plate 3', respectively. The motor 31', the gear box 32', the base plate 2', and the loudspeaker 22' are the same as those of the first embodiment. Two airplanes 51 can be rotated transversely.

The invention is not limited to the above embodiment but various modification thereof may be made. Further, various changes in form and detail may be made without departing from the scope of the invention.

I claim:

1. A rotary mechanism in a hollow shell comprising:

a base plate;

a cell chamber, a loudspeaker, an integrated circuit board, a switch, a motor and a transmission device disposed on said base plate;

said transmission device comprising a gear box and a follower plate;

said motor having a driving shaft;

a driving disk disposed on a top end of said driving shaft;

said gear box disposed above said base plate, and a plurality of posts disposed on said base plate to support said gear box;

a press plate extending transversely from a top of said gear box to cover said motor;

a driven shaft and a follower shaft crossing said gear box longitudinally;

a driven disk disposed on a top end of said driven shaft;

a belt surrounding said driving disk and said driven disk;

a follower plate disposed on a top end of said follower shaft;

a first and second rings disposed at two ends of said follower plate, respectively;

said first ring encircling a first magnet;

said second ring encircling a second magnet;

a driven pinion disposed on a middle portion of said driven shaft;

a follower gear disposed on a middle portion of said follower shaft;

said driven pinion engaging with said follower gear;

wherein said driving shaft drives said driven disk to rotate, and said driven shaft and said driven pinion are rotated simultaneously;

and wherein said driven pinion drives said follower gear to rotate, and said follower shaft and said follower plate are rotated simultaneously.

2. A rotary mechanism in a hollow shell as claimed in claim 1, wherein said hollow shell is a toy spectacle.

3. A rotary mechanism in a hollow shell as claimed in claim 1, wherein said hollow shell is a terrestrial globe.

* * * * *